US005089769A

United States Patent [19]

Petty et al.

[11] Patent Number: 5,089,769

[45] Date of Patent: Feb. 18, 1992

[54] PRECISION CURRENT MIRROR

[75] Inventors: Thomas D. Petty; Robert L. Vyne, both of Tempe, Ariz.

[73] Assignee: Motorola Inc., Schaumburg, Ill.

[21] Appl. No.: 607,958

[22] Filed: Nov. 1, 1990

[51] Int. Cl.[5] ..... G05F 3/26

[52] U.S. Cl. ..... 323/316; 323/312

[58] Field of Search ..... 323/312, 315, 316; 307/296.1, 296.4, 296.6

[56] References Cited

U.S. PATENT DOCUMENTS

| | | | |
|---|---|---|---|
| 4,536,702 | 8/1985 | Nagano | 323/316 |
| 4,647,841 | 3/1987 | Miller | 323/316 |
| 4,779,061 | 10/1988 | Matthies | 323/316 |
| 4,978,868 | 12/1990 | Giordano et al. | 323/316 |

*Primary Examiner*—Peter S. Wong

*Attorney, Agent, or Firm*—Michael D. Bingham

[57] ABSTRACT

A current mirror having an input and an output, comprises a diode coupled to the input to which an input current is supplied for providing a bias potential thereacross; an output transistor having an emitter, base and collector, said base and said emitter being coupled respectively across said diode and said collector being coupled to the output, said output transistor being responsive to said diode means for providing an output current the magnitude of which is proportional to said input current; and a compensation circuit coupled to said base of said output transistor and being responsive thereto for producing an output current that is injected at the input of the current mirror for cancelling base current errors caused by the base current of said output transistor.

7 Claims, 1 Drawing Sheet

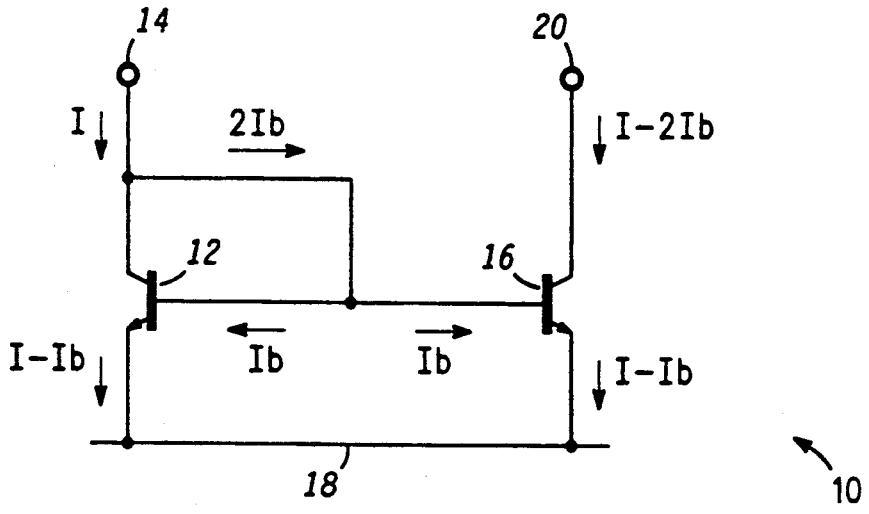
FIG. 1
-PRIOR ART-
FIG. 2
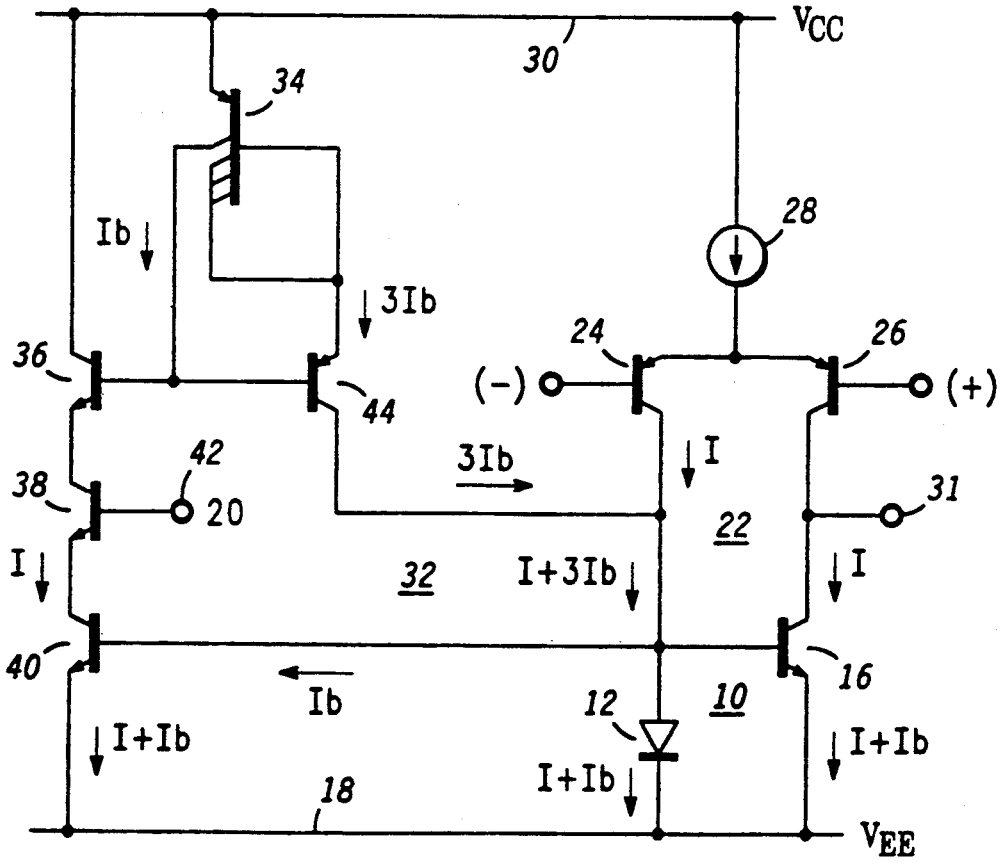

PRECISION CURRENT MIRROR

BACKGROUND OF THE INVENTION

The present invention relates to current mirror circuits that provide an output current which is ratioed to an input current and, more particularly, to a circuit for compensating base current errors in bipolar integrated current mirror circuits.

There are many applications for current mirror circuits in analog integrated circuits. Most commonly, a current mirror circuit or differential-to-single ended converter circuit is utilized in comparators and operational amplifiers. For example, most comparators and operational amplifiers include a differential input stage at which the outputs thereof there is generated a pair of differentially related currents. These related currents are converted to a single output current. In another application, a single input current may be supplied in which a single output current is desired that is ratioed to the input current. Most commonly, the current mirror or converter circuit is comprised of a diode-connected transistor coupled across the base-emitter of an output transistor wherein the former biases the latter. More particularly, an input current is supplied to the diode-connected transistor, which has its collector and base interconnected to the base of the output transistor while the emitters of the two devices are interconnected. By emitter area ratioing of the two transistors, an output current is developed at the collector of the output transistor that can be less than, greater than or equal to the input current. A problem with known current mirrors of the type described is related to base current error. Since a portion of the input current is utilized to provide the base current drive to the two transistors, the output current generally is not perfectly matched to the input current. There have been solutions proposed in the prior art to compensate for base current errors these solutions also present other problems. One known improved current mirror requires a fixed bias current and is not useful for use in operational amplifiers in which the bias current may be varied upon the operation of the amplifier. Another proposed solution requires at least two base-emitter voltage drops to be used which prevents the operational amplifier from providing maximum output voltage swing (using a single power supply).

Hence, a need arises for a precision current mirror circuit for compensating base current errors that has none of the disadvantages of the prior art.

SUMMARY OF THE INVENTION

In accordance with the above there is provided a current mirror having an input and an output, comprising a diode coupled to the input to which an input current is supplied for providing a bias potential thereacross; an output transistor having an emitter, base and collector, said base and said emitter being coupled respectively across said diode and said collector being coupled to the output, said output transistor being responsive to said diode means for providing an output current the magnitude of which is proportional to said input current; and a compensation circuit coupled to said base of said output transistor and being responsive thereto for producing an output current that is injected at the input of the current mirror for cancelling base current errors caused by the base current of said output transistor.

BRIEF DESCRIPTION OF THE DRAWINGS

FIG. 1 is a schematic diagram illustrating a simple prior art current mirror; and FIG. 2 is a schematic diagram of the precision current mirror of the preferred embodiment shown in combination with a differential input stage of an operational amplifier.

DETAILED DESCRIPTION OF THE PREFERRED EMBODIMENT

Turning to FIG. 1 there is shown prior art current mirror circuit 10 comprising transistor 12 connected as a diode having its collector and base interconnected to input 14 while its emitter is returned to power supply rail 18. The base of transistor 12 is also connected to the base of transistor 16 the emitter of which is coupled to rail 18 while an output current is provided at output 20. In the case of a simple current mirror, it is desired that the current I sourced to input 14 be provided at the collector of transistor 16 at output 20. It is understood that current mirror circuit 10 can be fabricated as an integrated circuit and by ratioing the emitter areas of the two transistors the output current can be set to any ratio of the input current.

In operation, assuming ideal transistors, the output current of current mirror 10 will not be equal to the input current I due to base current errors. As shown, a current 2Ib is subtracted from the input current I in order to supply the base currents of transistors 12 and 16. Thus, the emitter current of diode-connected transistor 12 is equal to I−Ib. If transistor 16 is perfectly matched to transistor 12, the emitter current will also be equal to I−Ib. Since, the emitter current $I_E$ of a transistor is equal to the sum of the base current Ib and the collector current $I_C$; i.e.:

$$I_E = Ib + I_C \text{ then;}$$

$$I_C = I_E - Ib \text{ and}$$

$$I_C = I - Ib - Ib \text{ or}$$

$$I_C = I - 2Ib.$$

Hence, the output current from the current mirror is less than the input current by a factor of twice the base current supplied to the two transistors. This error may well be unacceptable in applications requiring precision performance.

Turning now to FIG. 2, there is shown additional circuitry than is utilized with the current mirror described above to correct the base errors associated with the current mirror. It is understood that like components of the figures are designated with the same reference numbers. As illustrated, the current mirror circuit comprising transistors 12 and 16 is coupled to the differential outputs of differential stage 22. Differential stage may, for instance, be an input stage of an operational amplifier for receiving a differential input signal as shown at the bases of transistors 24 and 26. Differential stage 22 in combination with the current mirror circuit is well known in the art including differentially connected transistors 24 and 26 the emitters of which are interconnected to current supply 28. Current supply 28 is returned to the positive supply rail 30. In a conventional manner, the differentially related currents produced at the collectors of transistors 24 and 26 are converted into a single output current at the collector of transistor 16, at output 31. However, due to the foregoing described base error problem, since the current at the collector of transistor 16 does not match the current entering the diode, an offset voltage is produced at the inputs of the differential stage that is undesired. Cancellation circuit 32 of the present invention corrects the base error associated with the current mirror circuit comprising transistors 12 and 16 thereby reducing the offset voltage of the differential stage.

Cancellation circuit 32 is utilized in combination with diodeconnected transistor 12 and transistor 16 to establish a precision current mirror. Cancellation circuit 32 includes transistors 34 through 44. Transistor 34 is a multi-collector PNP transistor having its emitter coupled to rail 30, one collector coupled to the base of transistor 36 while the remaining collectors are interconnected to its base. Transistor 36 has its collector returned to rail 30 while its emitter is coupled to the collector of transistor 38, the base and emitter of which are coupled to terminal 42 and the collector of transistor 40 respectively. A bias potential is supplied to terminal 42 equal to approximately $2\theta$, where $\theta$ is equal to the baseemitter voltage of an NPN integrated transistor. The base of transistor 40 is coupled to the base of transistor 16. The interconnected collectors and base of transistor 34 are coupled to the emitter of transistor 44 which has its base coupled to the base of transistor 36 and its collector returned to the anode of diode connected transistor 12 and the base of transistor 16.

Cancellation circuit 32 corrects the base current error associated with current mirror 10 by recreating the base current of transistor 16 in the circuit and then injecting it into the input of current mirror 10 at the anode or collector-base interconnection of diode-connected transistor 12 to cancel the base current error created by transistors 16 and 40. Adding transistor 40, which is matched to transistors 12 and 16, produces additional base current error therethrough that is equal to that produced by transistor 16. The current in transistor 40 is sourced through transistor 38 to produce a current through transistor 36 that requires a base current equal to that of transistor 16 which is supplied from the collector of transistor 34. This base current is then tripled by the three interconnected collectors of transistor 34 and injected back into the collector of diode transistor 12 via transistor 44 to compensate the base errors. A total of three base currents is required for compensation because of the additional base current required to drive transistor 40. Transistors 38 and 44 are used to compensate for Early effects.

An important advantage of the method used by the present invention over prior art methods is that utilization circuit 22, which as an example is a differential amplifier stage, generates the compensation base current that is recreated by transistor 40 and which is returned and utilized to cancel base current errors. Thus, any changes in operating current through transistor 24 will be reflected in compensation circuit 32 and correlated thereby.

Hence, what has been described is a precision current mirror including compensation circuitry for recreating the base current error established in the current mirror and injecting a current into the input of the mirror to compensate for the base current error.

What is claimed is:

1. A current mirror having an input and an output, comprising:

diode means coupled to the input to which an input current is supplied for providing a bias potential thereacross;

an output transistor having an emitter, base and collector, said base and said emitter being coupled respectively across said diode means and said collector being coupled to the output, said output transistor being responsive to said diode means for providing an output current the magnitude of which is proportional to said input current; and a compensation circuit coupled to said base of said output transistor and being responsive thereto for producing an output current that is injected at the input of the current mirror for cancelling base current errors caused by the base current of said output transistor, said compensation circuit including:

a first transistor matched to said output transistor and having a base and emitter coupled respectively to said base and emitter of said output transistor and a collector;

a second transistor in cascode to said first transistor and having a base, an emitter and a collector;

a third transistor having a plurality of collectors and emitter and a base, said emitter being coupled to a terminal to which an operating potential is supplied, one of said plurality of collectors being coupled to said second transistor and the remaining collectors thereof being interconnected to said base thereof, said collector of said second transistor being coupled to said emitter of said third transistor; and a fourth transistor having an emitter coupled to said base of said third transistor, a base coupled to said base of said second transistor and a collector coupled to the input of the current mirror.

2. The current mirror of claim 1 wherein said diode means being a fifth transistor having a collector coupled to the input of the current mirror, a base coupled both to said base of said output transistor and the input of the current mirror and an emitter coupled to said emitter of said output transistor.

3. The current mirror of claim 2 wherein said compensation circuit includes a sixth transistor having a base to which a bias potential is supplied, a collector coupled to said emitter of said second transistor and an emitter coupled to said collector of said first transistor.

4. A current mirror having an input and output and including a diode to which an input current is supplied and an output transistor having a base and emitter coupled respectively across the diode and a collector coupled to the output at which an output current is provided, the improvement comprising a compensation circuit for recreating the base current in the output transistor for providing an output responsive to said recreated base current having a magnitude which is injected into the input of the current mirror to cancel errors introduced in the current mirror that are caused by the base current of the output transistor and any errors otherwise introduced by said compensation circuit, said compensation circuit includes:

a first transistor having a base and emitter coupled respectively to said base and emitter of the output transistor, and a collector;

a second transistor having an emitter coupled to said collector of said first transistor, a base and a collector, said collector being coupled to a power supply conductor;

a third transistor having a base, an emitter and a plurality of collectors, said emitter being coupled to said power supply conductor, one of said plurality of collectors being coupled to said base of said second transistor and selected ones of the other ones of said plurality of collectors being interconnected to said base; and means for coupling said base of said third transistor to the input of the current.

5. The current mirror of claim 4 wherein said coupling means includes a fourth transistor having a base coupled to said base of said second transistor, an emitter coupled to said base of said third transistor and a collector coupled to the input of the current mirror.

6. The current mirror of claim 5 wherein said compensation circuit includes a fifth transistor having a base to which a bias potential is supplied, a collector coupled to said emitter of said second transistor and an emitter coupled to said collector of said first transistor.

7. A current mirror comprising:

diode means coupled to an input of the current mirror to which an input current is supplied, said diode means having first and second electrodes;

a first transistor having first, second and control electrodes, said first and control electrodes being coupled respectively to said first and second electrodes of said diode means and said second electrode being coupled an output of the current mirror, said first transistor providing an output current proportional to said supplied input current;

a second transistor having first, second and control electrodes, said first and control electrodes being respectively coupled to said first and control electrodes of said first transistor, said second transistor being responsive to said first transistor for providing a current at said second electrode thereof that is substantially equal to said output current; and circuitry including a third transistor of opposite conductivity type of said first and second transistors and having a plurality of collectors, a base and an emitter, said emitter being coupled to a power supply conductor, predetermined ones of said plurality of collectors being coupled to said base and to said input of the current mirror for supplying additional current thereto.

* * * * *

UNITED STATES PATENT AND TRADEMARK OFFICE

CERTIFICATE OF CORRECTION

PATENT NO. : 5,089,769

DATED : February 18, 1992

INVENTOR(S) : Thomas D. Petty and Robert L. Vyne

It is certified that error appears in the above-identified patent and that said Letters Patent is hereby corrected as shown below:

In column 4, line 58, claim 4, please insert the word --current-- before the word "responsive" and after the word "output".

Signed and Sealed this

First Day of June, 1993

*Attest:*

Michael K. Kirk

MICHAEL K. KIRK

*Attesting Officer*

*Acting Commissioner of Patents and Trademarks*